US010733942B2

(12) United States Patent
Imai et al.

(10) Patent No.: US 10,733,942 B2
(45) Date of Patent: Aug. 4, 2020

(54) AMBIENT LIGHT COLOR COMPENSATION SYSTEMS AND METHODS FOR ELECTRONIC DEVICE DISPLAYS

(71) Applicant: Apple Inc., Cupertino, CA (US)

(72) Inventors: Francisco H. Imai, San Jose, CA (US); Chi Zhang, Cupertino, CA (US); Adria Fores Herranz, San Jose, CA (US); Jiaying Wu, San Jose, CA (US); Arthur L. Spence, San Jose, CA (US); Marc Albrecht, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 39 days.

(21) Appl. No.: 16/044,408

(22) Filed: Jul. 24, 2018

(65) Prior Publication Data

US 2019/0318696 A1 Oct. 17, 2019

Related U.S. Application Data

(60) Provisional application No. 62/657,646, filed on Apr. 13, 2018.

(51) Int. Cl.

| | |
|---|---|
| ***G09G 5/10*** | (2006.01) |
| ***G09G 3/34*** | (2006.01) |
| ***G09G 3/20*** | (2006.01) |

(52) U.S. Cl.
CPC ..... *G09G 3/3413* (2013.01); *G09G 3/2003* (2013.01); *G09G 2320/0666* (2013.01); *G09G 2340/06* (2013.01); *G09G 2360/144* (2013.01)

(58) Field of Classification Search
None
See application file for complete search history.

(56) References Cited

U.S. PATENT DOCUMENTS

2004/0196250 A1* 10/2004 Mehrotra ..... G09G 5/02 345/102
2011/0199350 A1* 8/2011 Wilson ..... G09G 5/02 345/207
2011/0305391 A1* 12/2011 Kunkel ..... H04N 1/6088 382/167

* cited by examiner

*Primary Examiner* — Adam R. Giesy
(74) *Attorney, Agent, or Firm* — Jaffery Watson Mendonsa & Hamilton LLP

(57) ABSTRACT

Aspects of the subject technology relate to electronic devices with displays and ambient light sensors. An electronic device modifies the color of images to be displayed based on measured ambient light color. The modification is performed in a perceptually uniform color space and includes a determination of a bleaching effect of reflected ambient light, and a determination of a color correction factor to be applied within the perceptually uniform color space, based on the determined bleaching effect. The modification may also include an application of a strength factor that mitigates out-of-gamut colors in color compensated images.

21 Claims, 7 Drawing Sheets

AMBIENT LIGHT COLOR COMPENSATION SYSTEMS AND METHODS FOR ELECTRONIC DEVICE DISPLAYS

CROSS-REFERENCE TO RELATED APPLICATIONS

The present application claims the benefit of U.S. Provisional Patent Application Ser. No. 62/657,646, entitled "AMBIENT LIGHT COLOR COMPENSATION SYSTEMS AND METHODS FOR ELECTRONIC DEVICE DISPLAYS" filed on Apr. 13, 2018, which is hereby incorporated by reference in its entirety for all purposes.

TECHNICAL FIELD

The present description relates generally to electronic devices with displays, and more particularly, but not exclusively, to ambient light color compensation systems and methods for electronic device displays.

BACKGROUND

Electronic devices are often provided with displays such as organic light-emitting diode (OLED) displays or liquid crystal displays (LCDs). Particularly for portable electronic devices with displays, the displays are often operated and viewed in different ambient lighting conditions, which can affect the appearance of images displayed on the display.

BRIEF SUMMARY

Aspects of the subject technology relate to electronic devices with displays and ambient light sensors. An electronic device modifies the color of images to be displayed based on measured ambient light color. The modification is performed in a perceptually uniform color space and includes a determination of a bleaching effect of reflected ambient light, and a determination of a color correction factor to be applied within the perceptually uniform color space, based on the determined bleaching effect. The modification may also include an application of a strength factor that mitigates out-of-gamut colors in color compensated images.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
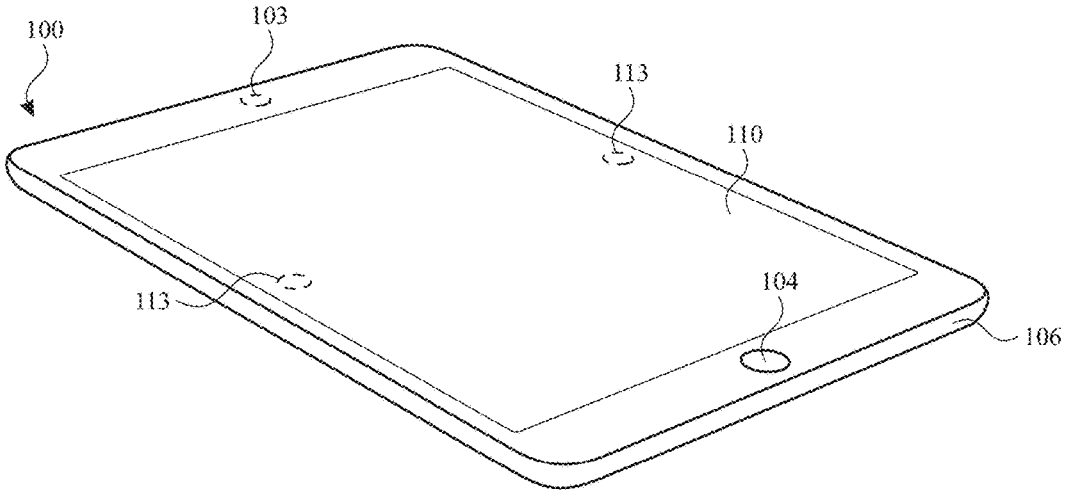
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, computers, set-top boxes, wireless access points, and other electronic equipment that may include displays. Displays may be used to present visual information and status data and/or may be used to gather user input data. A display may include an array of display pixels. Each display pixel may include one or more colored subpixels for displaying color images. For example, each display pixel may include a red subpixel, a green subpixel, and blue subpixel.

Each display pixel or subpixel generates light based on display data for generating images representing pictures, text, video, or other display content on the front of the display. The colored subpixels of the display are operated to generate images having a particular color at each pixel. However, in some scenarios, ambient light from the environment surrounding the device can be reflected from the display. This reflected light is added to the light generated by the display and can affect the visual appearance of the images generated on the front of the display.

One aspect of a displayed image that can be changed by reflected ambient light, is the color of the displayed image. This color change can be particularly problematic when the device is operated outdoors and the display is exposed to direct and/or indirect sunlight. Typically, a user of a device will orient the device to avoid specular reflections that are directly reflected from the front surface of the display. However, even in these orientations, portions of the ambient light can pass through the front surface of the display and be reflected by one or more structures within the display, before passing again through the front of the display in an outward direction, in combination with the display-generated light. These diffuse reflections can be scattered and/or reflected among one or more different layers beneath the surface of the display before being re-emitted through the front of the display.

These diffuse reflections can cause images generated by the display to appear washed out due to a decrease in the color gamut of the observed image caused by the addition of non-negligible reflected light to the display-generated light coming out of the display. This effect is referred to herein as a physical reduction in the colorfulness of the displayed image.

Moreover, the human eye itself responds differently to display light when the eye is exposed to different ambient light conditions. In particular, high levels of brightness reduce the efficiencies of the cone cells in the human retina, which can cause a further, physiological reduction in the colorfulness of a displayed image.

In accordance with various aspects of the subject disclosure, systems and methods are provided for mitigating physical and/or physiological reductions in the apparent colorfulness of an image displayed on an electronic device display, in various ambient lighting conditions. In particular, electronic devices are provided that include a display and an ambient light sensor. Images to be displayed on the device display are modified, prior to display, based on ambient light measurements obtained using the ambient light sensor. Further details of these modifications to images for display, which can compensate for a potential of loss in colorfulness due to high ambient brightness while preserving image quality, are described hereinafter.

FIG. 1 shows an example of an electronic device 100 that includes a display and an ambient light sensor. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 includes a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 may include display pixels (see, e.g., light-emitting elements 516 of FIG. 5). The front surface of display 110 is visible in FIG. 1.

As indicated, device 100 includes one or more ambient light sensors, which may be implemented as display-integrated ambient light sensors 113 or ambient light sensors 103 that are separate from the display. Display 110 may have a transparent cover layer such as a glass cover layer that allows ambient light from the environment surrounding device 100 to reach one or more of ambient light sensors 103 or 113.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations. In some implementations, electronic device 100 may be provided in the form of a computer integrated into a computer monitor. Display 110 may be mounted on a front surface of housing 106 and a stand may be provided to support housing (e.g., on a desktop).

Ambient light sensors 103 may be disposed in a common plane with display 110, as in FIG. 1, to help ensure that the ambient light sensed by the sensor 103 accurately indicates the ambient light that is incident on the display. However, one or more ambient light sensors 103 may also, or alternatively, be implemented away from the display, such is in the lower portion of a laptop housing to provide additional ambient light data that can be used in operation of the display and/or other features of device 100.

Display 110 may be implemented as a liquid crystal display (LCD), a light-emitting diode (LED) display such as an organic light-emitting diode (OLED) display, or another type of display such as a plasma cell display, or a display that includes electrophoretic display elements, electrowetting display elements or other suitable display pixel structures.

Displays such as LCDs and OLED displays typically include various layers of materials, structures, and electronic components arranged to generate display light for displaying images. Ambient light that is incident on the display can pass into and through some of the display layers and can be reflected by some of the display layers. Examples in which display 110 is implemented as an LCD and as an OLED display are shown in FIGS. 2 and 3, respectively.

Figure 2:
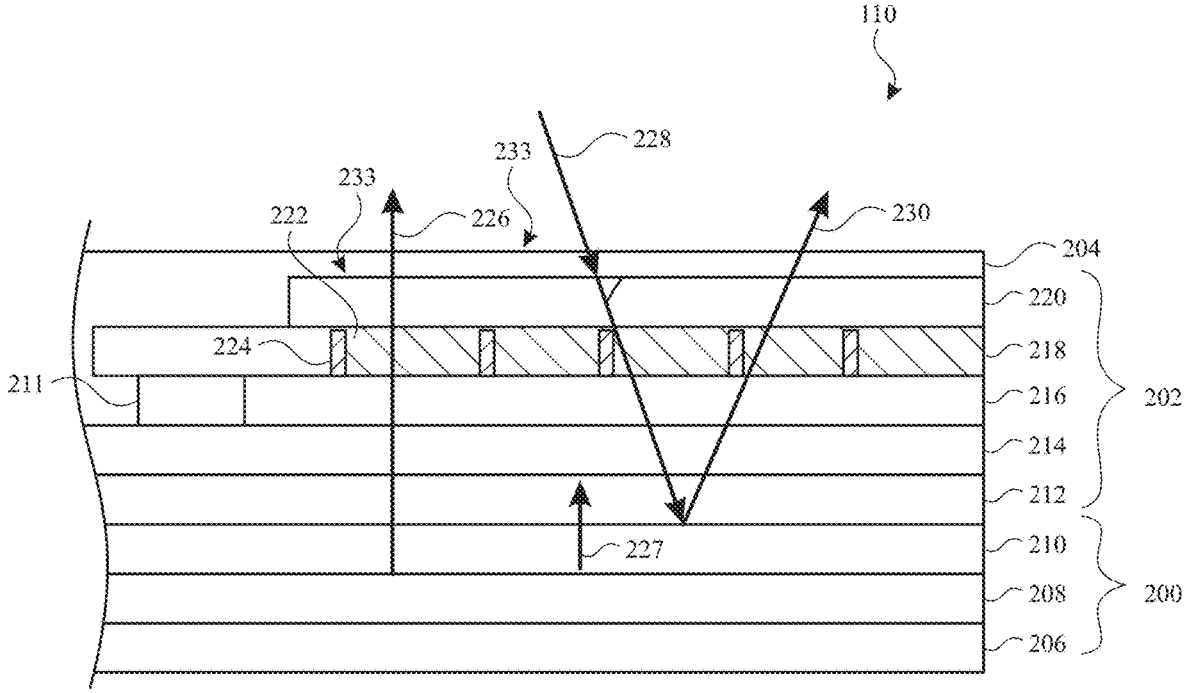
FIG. 2 illustrates a cross-sectional view of a portion of a liquid crystal display for an electronic device in accordance with various aspects of the subject technology.
Figure 3:
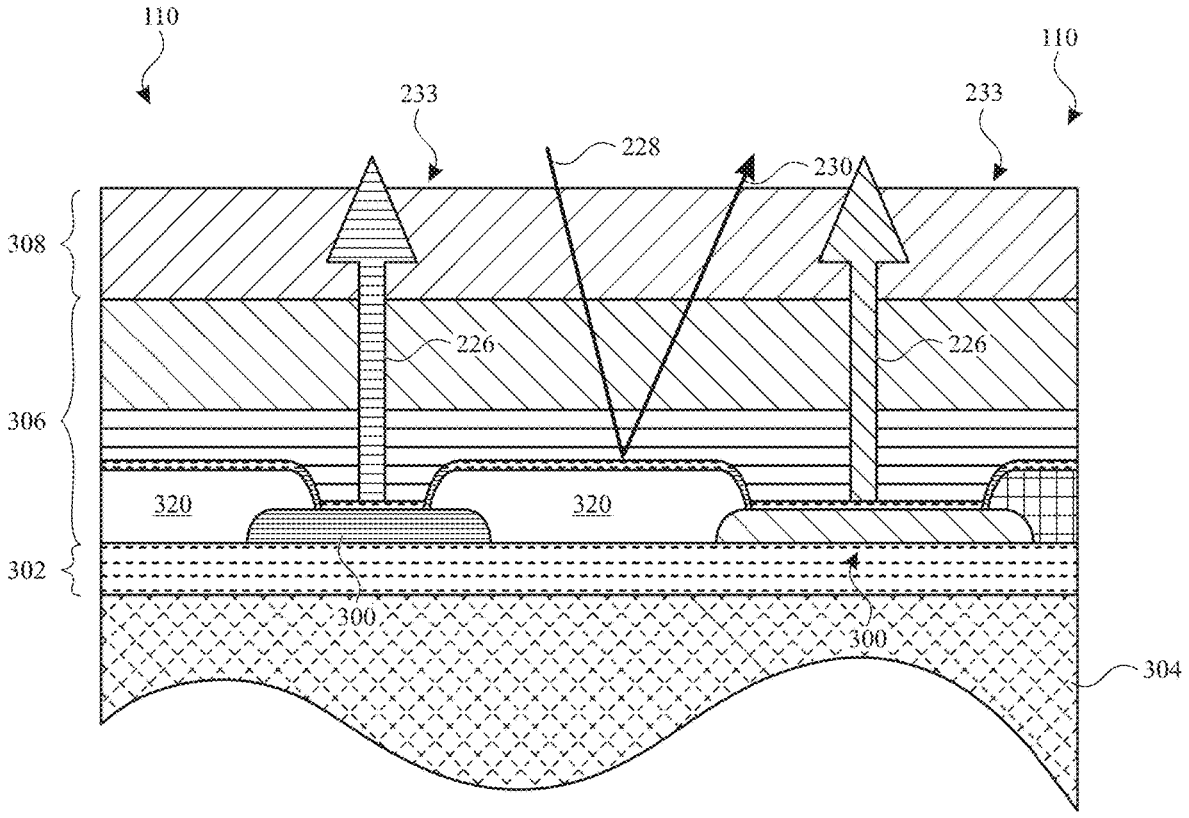
FIG. 3 illustrates a cross-sectional view of a portion of a light-emitting diode display for an electronic device in accordance with various aspects of the subject technology.

In the example of FIG. 2, a cross-sectional side view of an LCD implementation of display 110 is shown. In the example of FIG. 2, display 110 includes an LCD module 202 interposed between a backlight assembly 200 and a transparent cover layer 204 (e.g., a transparent plastic or glass cover layer). Cover layer 204 may include other layers such as a touch-sensitive layer (e.g., formed from an array of transparent electrodes such as indium tin oxide electrodes that sense user touch and/or other motions on or near the surface of the display) and/or other layers such as antireflection coatings, smudge-resistant coatings, or optical layers.

Backlight assembly 200 may be a two-dimensional array of light-emitting diodes (LEDs) arranged in one or more layers such as layer 208 or backlight assembly may be an edge-lit backlight as in the example of FIG. 2. In the example of FIG. 2, backlight assembly 200 includes light guide layer 208 configured to guide the light from an internal light source (e.g., one or more LEDs or other light sources arranged along an edge of the light guide layer) throughout the display area of display 110. Backlight assembly 200 may also include a reflector layer 206 and one or more optical films 210.

As shown in FIG. 2, LCD module 202 includes thin film transistor (TFT) layer 214, liquid crystal layer 216, and color filter layer 218 interposed between top polarizer layer 220 and bottom polarizer layer 212. Thin film transistors in TFT layer 214 are operable to selectively control liquid crystals in liquid crystal layer 216 to selectively change the polarization of backlight from backlight assembly 200 that has been polarized by bottom polarizer layer 212.

Color filter layer 218 includes color filter material 222 for each pixel 233. Color filter material 222 of one color (e.g., red, green, or blue resin materials) for one pixel (or subpixel) may be separated from the color filter material 222 of one or more adjacent pixels (or subpixels) by an opaque masking material (e.g., a black paint, ink, or resin). Red, green, and blue color filter elements 222 are configured such that light passing through will have primarily red, green, or blue wavelengths, respectively. Masking material 224 may be a light-opaque mask or matrix which defines a red, green, or blue pixel (or subpixel) area and prevents light transmitted through color filter elements 222 from diffusing or "bleeding" into adjacent pixels.

When TFT layer 214 arranges the liquid crystals of a particular display pixel 233 to cause the polarization of some or all of the light 226 passing through that pixel to rotate to match the polarization of top polarizer 220, that portion of light 226 is filtered by color filter layer 218 and passes through top polarizer 220 and cover layer 204 to exit the display as display light. When TFT layer 214 arranges the liquid crystals of a particular display pixel 233 to allow the polarization of the light 227 passing through that pixel to remain the same as the polarization of bottom polarizer 212, that light 227 is prevent from exiting the display to form dark or black pixel of a displayed image.

However, FIG. 2 also shows how ambient light 228 can pass into the layers of display 110 (e.g., into cover layer 204, LCD module 202, and/or backlight assembly 200). In the example, of FIG. 2, ambient light 228 is reflected from optical films 210 of backlight assembly 200. However, depending on the intensity, color, polarization, and angle of incidence of ambient light 228, the portion of ambient light 228 that enters display 110 can be reflected, polarized, filtered, and/or absorbed and reemitted by any or all of the layers, structures, materials, and/or electronic components before exiting display 110 as reflected light 230. In the example of FIG. 2, an ambient light sensor 211 is integrated into the layers of the display. However, the location of ambient light sensor 211 is illustrative and one or more ambient light sensors can be otherwise integrated with the display and/or located separately from the display.

FIG. 3 shows a cross-sectional side view of a portion of display 110 implemented as an OLED display. In the example of FIG. 3, display 110 includes an OLED assembly 306 interposed between a transparent cover layer 308 such as a glass or plastic cover layer and TFT layer 302. Cover layer 308 may include other layers such as a touch-sensitive layer (e.g., formed from an array of transparent electrodes such as indium tin oxide electrodes that sense user touch and/or other motions on or near the surface of the display) and/or other layers such as antireflection coatings, smudge-resistant coatings, or optical layers.

OLED assembly 306 includes various structures and layers for generating display light 226 responsive to control signals in TFT layer 302. In the example of FIG. 3, OLED assembly 306 forms an array of OLED pixels 233 each formed from a portion of an anode layer, organic emitter layer 300, and a cathode layer, the portion defined by pixel definition layer 320. Pixel definition layer 320 may be formed from, for example, an optically opaque material that optically defines the light-emitting area of each OLED pixel 233.

TFT layers 302 include various circuit layers (e.g., including transistor structures for transistors, gate lines, and data lines, gate insulation layers, shield metal layers, conductive vias, and buffer layers) and may be formed on one or more substrate layers 304. Substrate layers 304 may include one or more polymer layers such as a polyimide layer and/or a polyethylene terephthalate (PET) layer. TFT layers 302 may also include a planarization layer formed over transistors therein to provide a planar surface on which pixel structures such as the anode and pixel definition layer 420 are formed. OLED layers 306 may include additional layers such as a thin-film-encapsulation layer and a polarizer layer.

Because the layers, materials, structures, and/or electronic components can be polarizing, and/or color filtering upon transmission or reflection, reflected light 230 in either of the display implementations of FIGS. 2 and 3 (or other implementations) may have a different color, polarization, intensity or incidence angle from the received ambient light 228.

During manufacturing of device 100 and/or display 110 (in an LCD, OLED, or other implementation), display reflectance data may be measured that describes the color distribution of reflected light 230 under various types of ambient illumination 228 (e.g., direct sunlight, reflected sunlight, filtered sunlight, polarized sunlight, fluorescent light, incandescent light, firelight, or other forms of ambient light). This display reflectance data may be stored (e.g., in memory of each device 100 or remotely accessible memory) so that, when ambient light is measured by one or more of ambient light sensors 103 and/or 113, the amount, distribution, and color of the portion of that light that is reflected from the display can be determined (e.g., by looking up or calculating the properties of the reflected light by modifying the measured incident ambient light with the known display reflectance properties in the stored display reflectance data).

The display reflectance data may include for example, a two-dimensional distribution of intensities and colors expected for each of several types of ambient light. During operation, the two-dimensional distribution of intensities and colors that will be reflected by the display can be selected from the display reflectance data based on an identification of the type of ambient light in the environment around the device. The type of ambient light may be identified based on a measured intensity and/or a measured spectral distribution of the ambient light.

Figure 4:
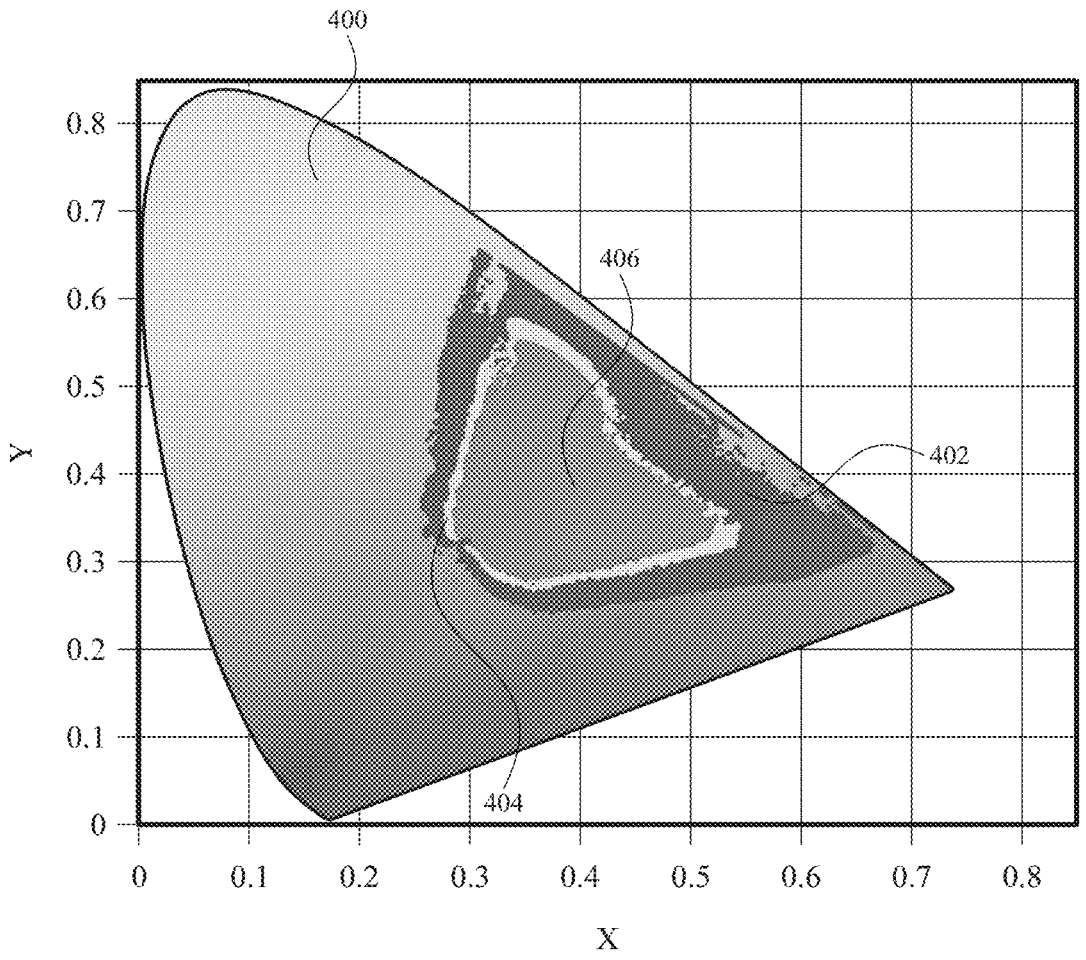
FIG. 4 illustrates various color gamuts associated with displayed images in accordance with various aspects of the subject technology.

FIG. 4 shows a chromaticity diagram in which the effect of adding reflected light 230 to display light 226 can be seen. The chromaticity diagram of FIG. 4 represents a two-dimensional projection of a three-dimensional color space. The color generated by a display such as display 110 may be represented by chromaticity values x and y. The chromaticity values may be computed by transforming, for example, three color intensities (e.g., intensities of colored light emitted by a display) such as intensities of red, green, and blue light into three tristimulus values X, Y, and Z, and normalizing the first two tristimulus values X and Y (e.g., by computing $x=X/(X+Y+Z)$ and $y=Y/(X+Y+Z)$ to obtain normalized x and y values). Transforming color intensities into tristimulus values may be performed using transformations defined by the International Commission on Illumination (CIE) or using any other suitable color transformation for computing tristimulus values.

Any color generated by a display such as display 110 may therefore be represented by a point (e.g., a point corresponding to a pair of chromaticity values x and y) on a chromaticity diagram such as the diagram shown in FIG. 4. Bounded region 400 of FIG. 4 represents the limits of visible light that may be perceived by humans (i.e., the total available color space). The colors that may be generated by a display are contained within a sub-region of bounded region 400 and define a color gamut for that display. Each image displayed by the display has a corresponding color gamut that is generally contained within a sub-region of the sub-region for the display. In the example of FIG. 4, gamut 402 represents the intended colors of an image for display by display 110.

However, due to the addition of reflected light 230 to display light 226, the color gamut of the displayed image is reduced from intended gamut 402 to physically reduced gamut 404. Moreover, due to the physiological changes in the user's eye due to the presence of the ambient light that causes reflected light 230, the gamut of the observed image is further reduced to observed gamut 406.

In order to correct observed gamut 406 to more closely match intended gamut 402, processing circuitry of device 100 generates and applies a color compensation to the image to be displayed based on the measured ambient light and the known display reflectance properties stored in the display reflectance data.

Figure 5:
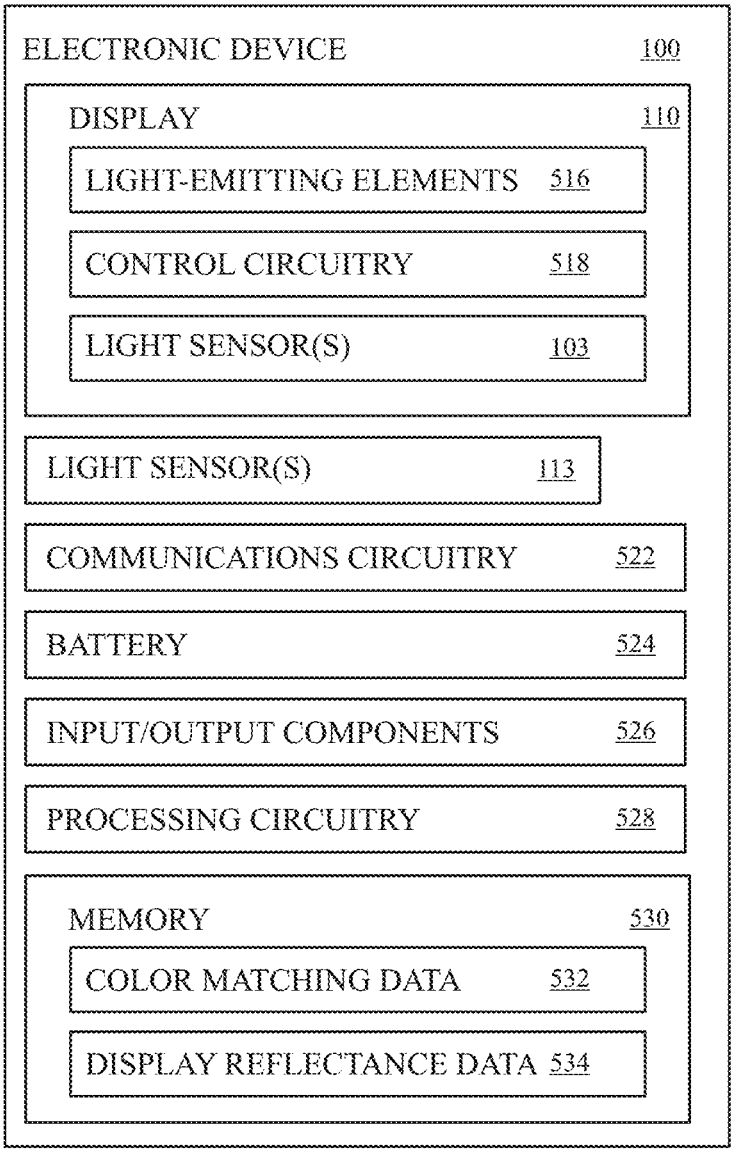
FIG. 5 illustrates a schematic block diagram of an electronic device having a display in accordance with various aspects of the subject technology.

FIG. 5 shows a schematic block diagram of device 100 in which various components for performing this color compensation are shown. In the example of FIG. 5, device 100 includes display 110 having display control circuitry 518 and light-emitting elements 516. Light-emitting elements 516 may be liquid crystal display pixels as in the example of FIG. 2, OLED pixels as in the example of FIG. 3, or plasma cells, electrophoretic display elements, electrowetting display elements, or other suitable display pixel structures.

Color compensation operations may be performed by display control circuitry 518 and/or processing circuitry 528 (e.g., a central processing unit or other integrated circuit) for device 100 based on ambient light data generated by ambient light sensors 113 that are integrated with display 110 and/or ambient light sensors 103 that are separate from the display.

As shown, device 100 includes processing circuitry 528 and memory 530. Memory 530 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry 528. Processing circuitry 528 may be used in controlling the operation of device 100. Processing circuitry 528 may sometimes be referred to as system circuitry or a system-on-chip (SOC) for device 100.

Processing circuitry 528 may include a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, processing circuitry 528 may be used to run software for device 100, such as, display content generation functions, color compensation operations, display data conversion operations, internet browsing applications, email applications, media playback applications, operating system functions, software for capturing and processing images, software implementing functions associated with gathering and processing sensor data, and/or software that controls audio, visual, and/or haptic functions.

As shown in FIG. 5, memory 530 may store display reflectance data 534 for determining a distribution of reflected light for a given measured ambient light condition (measured using ambient light data from ambient light sensors 103 and/or 113). Memory 530 may also store color matching data 532 for converting image data and/or measured light data between various color spaces.

In the example of FIG. 5, device 100 also includes communications circuitry 522, battery 524, and input/output components 526 such as a touch-sensitive layer of display 110, a keyboard, a touch-pad, and/or one or more real or virtual buttons.

The colorfulness compensation described herein is performed in a perceptually uniform manner that provides improved control of the colorfulness without affecting image brightness levels. In particular, the compensation operations described herein are performed in a perceptually uniform color appearance space. Although various perceptually uniform color appearance spaces are available, compensation operations in the IPT color space are described herein as an example. The dimensions of the IPT color space are "I"—corresponding to perceptual brightness, "P"—corresponding to redness-greenness, and "T"—corresponding to "yellowness-blueness".

A brightness statistic for an image or for a distribution of ambient light may be the mean or median of a histogram of I values. A colorfulness statistic for an image or for a distribution of ambient light may be a mean or median of a histogram of colorfulness values, the colorfulness given by the square root of the sum of the squares of I and P.

Figure 6:
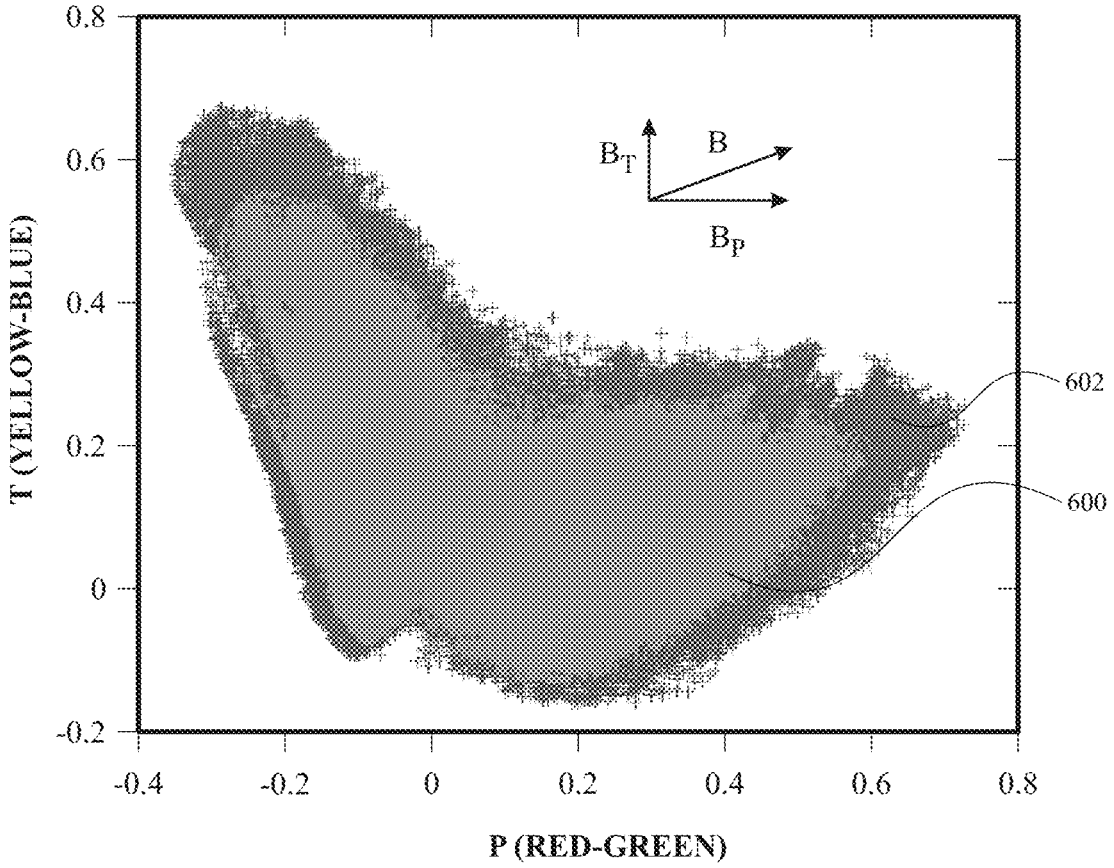
FIG. 6 illustrates various bleached and compensated color gamuts associated with a displayed image in accordance with various aspects of the subject technology.

A colorfulness compensation factor, for compensating for the presence of ambient light, may be implemented as a multiplicative color compensation factor "B" to the color channels P and T. As indicated in FIG. 6, the multiplicative factor B can be decomposed in the P and T directions as $B_P$ and $B_T$ components respectively. The compensation factors $B_P$ and $B_T$ may be determined, in one example, based the relationship between image overall brightness (that can be calculated from the brightness histogram) and the reading from ambient light sensor. In this example, the brightness level from the ambient light sensor in relation to the image brightness will determine the level of colorfulness compensation. The colorimetric information reading form the light sensor may be used to determine the relative bias that needs to be applied to the compensation factors $B_P$ and $B_T$. For example, compensation factors $B_P$ and $B_T$ may be determined based on ratios or differences of original to bleached P and T values, as described in further detail hereinafter. The colorfulness compensation leading to increase in color gamut is illustrated in FIG. 6.

In particular, FIG. 6 shows a colorfulness diagram in which the color gamut 600 of an image to be displayed is boosted to a compensated color gamut 602. Compensated color gamut 602 is generated by applying compensation factor B to color gamut 600 (e.g., by multiplying the P values of the original image by the P-component, $B_P$, of factor B and by multiplying the T values of the original image by the T-component, $B_T$, of factor B). $B_P$ may be the ratio or the difference of the P value(s) of the original (input) image and the corresponding P value(s) of a bleached version of the original image, the bleached version being computed based on the measured ambient light data, as described in further detail below. $B_T$ may be the ratio or the difference of the T value(s) of the original (input) image and the corresponding T value(s) of the bleached version of the original image. $B_P$ and $B_T$ may be commons values for all pixels of an image, derived from ratios of the average or median P and T values respectively, or may be determined and applied for each pixel or several groups of pixels. Color gamut 600 may, for example, represent the same color gamut as gamut 402 of FIG. 4, but in the IPT color space. The conversion between the chromaticity space of FIG. 4 and the colorfulness space of FIG. 6 is described in further detail below.

Figure 7:
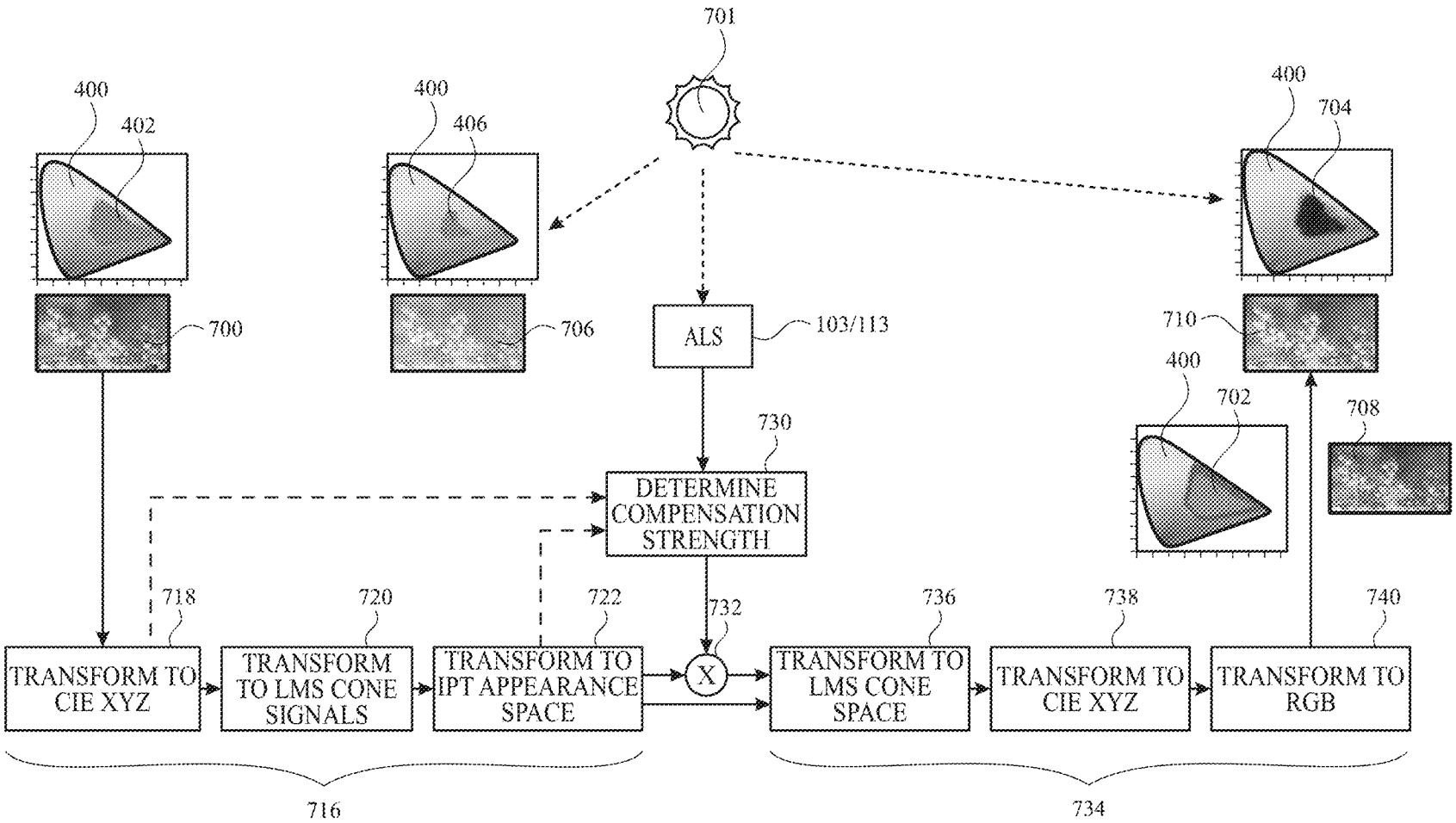
FIG. 7 illustrates a flow diagram with illustrative operations for operating an electronic device having a display in accordance with various aspects of the subject technology.

FIG. 7 is a flow diagram that illustrates various operations in the color compensation described herein. As shown in FIG. 7, an input image 700 may have a representative color gamut 402. It is desired that a viewer, viewing display 110 of device 100, views image 700 with color gamut 402 in any of various ambient light conditions. However, as noted above, viewing the display with an ambient light source 701 (e.g., the Sun in daylight, which can provide 20,000 to 50,000 lux) can cause image 700 to appear as a bleached or washed-out image 706 with a reduced color gamut 406. The operations of FIG. 7 generate a compensated image 708, with a compensated color gamut 702 that, when displayed on display 110 and viewed under ambient light source 701, appears as observed image 710 having an observed color gamut 704 that matches the desired color gamut 402 of input image 700 (even though compensated image 708 is not the same as input image 700).

As shown in FIG. 7, ambient light data (one or more ambient light measurements such as a brightness and a color of the ambient light detected by an ambient light sensor) is provided from one or more ambient light sensors 103/113. The ambient light data may be raw channel data from the ambient light sensor or may include processed ambient light data such as a spectral power distribution of the ambient light. At block 730, the spectral power distribution of the ambient light may be determined (if not received from the sensor) and combined (e.g., convolved or integrated) with color matching data 532 and display reflectance data 534 to determine tristimulus values for the ambient light that is reflected by the display.

One or more image transformations 716 are performed for input (original) image 700. As shown in FIG. 7, image transformations 716 may include a transformation from International Commission on Illumination (CIE) red-green-blue (RGB) values to tristimulus values at block 718, a transformation of the tristimulus values to LMS cone signals (image cone responses) at block 720, and a transformation from the LMS cone signals to IPT values or other perceptually uniform color space color and brightness values. As shown, the tristimulus values for the input image and the IPT values for the input image may be provided to block 730.

At block 730, the bleaching effect of the ambient light may be determined by computing tristimulus values of an expected bleached image (e.g., by vector addition of the tristimulus values of the original image from block 718 and the tristimulus values of the reflected light).

At block 730, the tristimulus values of the bleached image are also transformed into IPT values for the bleached image. The IPT values of the bleached image are combined with the IPT values of the original image from block 722 to generate the compensation values $B_P$ and $B_T$ as described above in connection with FIG. 4 (e.g., by vector subtraction or a ratio of the original and bleached P and T values respectively).

Color compensation values such as $B_P$, $B_T$, and a strength are provided to combiner 732, which combines the compensation values with the P and T values of the original image to generate compensated IPT values. For example, combiner 732 may generate the compensated IPT values by vector addition of the original P and T values and the computed $B_P$ and $B_T$ values. The product of the addition may be modified (e.g., multiplied) by the strength parameter to generate the compensated IPT values.

The strength value may be generated at block 730 to ensure that the compensated IPT values do not extend beyond a desired range (e.g., beyond gamut 400 or a display-specific sub-region gamut of 400 of FIG. 4). For example, the strength parameter may help mitigate out-of-gamut colors in a compensated image that cannot be addressed by the display. In this way, clipping of the compensated image can be mitigated or avoided. The strength parameter may be determined based on the Y tristimulus value of the ambient light data and/or the input image and known physical properties of the display (e.g., known native panel primaries).

As shown in FIG. 7, various inverse transformation operations 734 may be applied to the compensated IPT values to generate the compensated image. In the example of FIG. 7, inverse transformation operations 734 include a transformation 736 of the compensated IPT values to LMS cone values, a transformation 738 from the LMS cone values to XYZ tristimulus values, and a transformation 740 from the XYZ tristimulus values to compensated RGB image values of compensated image 708 which, when viewed under ambient light 701, appears to an observer as observed image 710 having color gamut 704 that matches the intended color gamut 402 of the input (original) image.

Figure 8:
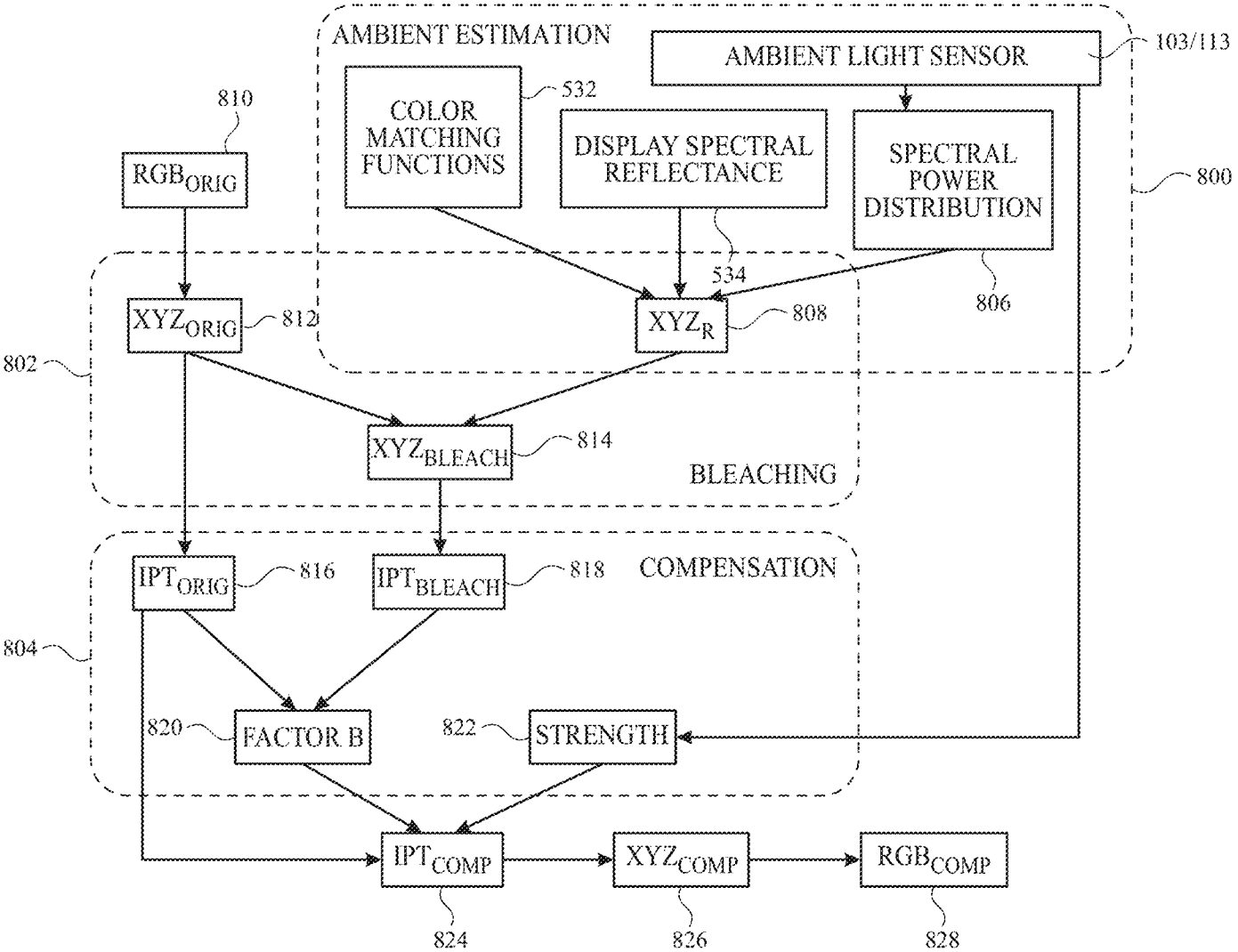
FIG. 8 illustrates a flow diagram with further details of illustrative operations for operating an electronic device having a display in accordance with various aspects of the subject technology.

FIG. 8 is a flow diagram that breaks out some of the operations of block 730 and other blocks of FIG. 7. As shown in FIG. 8, electronic device 100 may perform color compensation for ambient light operations that include ambient light estimation operations 800, bleaching computation operations 802 and compensation operations 804.

As shown, ambient light estimation operations may include combining a spectral power distribution 806 determined based on ambient light measurements from one or more ambient light sensors 103/113 with color matching data 532 and display spectral reflectance data 534 (e.g., via a convolution or integration) to form expected reflection data such as reflected light tristimulus values 808 (denoted $XYZ_R$) of a portion of the ambient light that is reflected by the display. However, it should be appreciated that in some scenarios reflected light tristimulus values 808 may be determined directly from one or more channel readings of ambient light sensor(s) 103/113 (e.g., without first computing the spectral power distribution).

As shown, bleaching computation operations 802 include a combination of reflected light tristimulus values 808 with image tristimulus values 812 of the original (input) image (denoted $XYZ_{ORIG}$ and derived from the original image RGB values 810). The combination may be an addition of $XYZ_R$ and $XYZ_{ORIG}$, representing the addition of the display-generated light and the reflected light.

As shown, compensation operations 804 include a combination (e.g., vector subtraction or ratio) of IPT values 816 of the original image (sometimes referred to as image perceptually uniform color space values and denoted $IPT_{ORIG}$) and color bleaching data (e.g., IPT values 818 of the bleached image (denoted $IPT_{bleach}$) determined from a transformation of the tristimulus values 814 of the bleached image (denoted $XYZ_{bleach}$)) to determine the compensation factor 820. Compensation operations 804 may also include a determination of the strength parameter 822 for the color compensation based on the ambient light sensor data. Compensation operations 804 may also include a combination of the original IPT values 816, the compensation factor 820 (factor B), and the strength factor 822 to generate compensated IPT values 824 (denoted $IPT_{COMP}$).

The compensated IPT values 824 are then inverse transformed (e.g., at blocks 736 and 738 of FIG. 7) to compensated XYZ values 826 and (e.g., at block 740) to compensated RGB values 828 of compensated image 708 (e.g., a compensated output image).

The operations of FIGS. 7 and/or 8 can be performed (e.g., by processing circuitry 528 of device 100 and/or control circuitry 518 of display 110) to generate images on display 110 that have a colorfulness that, when viewed under the current ambient light in the environment around the device, substantially matches the intended colorfulness of the image.

The systems and method disclosed herein provide a color compensation for images displayed on an electronic device display under ambient light from an environment external to the device. It should also be appreciated that the systems and method described herein can be used to employ diffuse reflections of ambient light from the display as a portion of the light emitted by the display (e.g., to reduce the amount of light the display generates for each displayed image, which can reduce power consumption by the display). It should also be appreciated that the color compensation methods and systems disclosed herein can be applied in combination with operations to boost the overall visibility of displayed images by modifying the overall brightness of the display responsive to changes in the measured ambient light brightness.

The operations described above in connection with FIGS. 7 and 8 can be performed by processing circuitry 528 running software stored in memory 530, by firmware of processing circuitry 528 or display control circuitry, or a combination thereof for each image to be displayed and for an ambient light measurement at or near the time the image is displayed. However, it should also be appreciated that some or all of the operations described above in connection with FIGS. 7 and 8 can be embodied (e.g., for some common image color gamuts and some common ambient light conditions) in a multi-dimensional lookup table that maps the original RGB values of the original (input) image to compensated RGB values of a compensated image.

In accordance with various aspects of the subject disclosure, an electronic device is provided that includes a display having an array of display pixels configured to emit colored display light, an ambient light sensor, and processing circuitry. The processing circuitry is configured to transform an image to be displayed with the display to a perceptually uniform color space, obtain an ambient light measurement from the ambient light sensor, determine a color compensation factor based on the transformed image and the ambient light measurement, apply the color compensation factor to the transformed image, perform an inverse transform of the transformed image with the color compensation applied to obtain a compensated image, and provide the compensated image to the display, for display by the array of display pixels.

In accordance with other aspects of the subject disclosure, an electronic device is provided that includes a display having an array of display pixels configured to emit colored display light, an ambient light sensor, and processing circuitry. The processing circuitry is configured to obtain an ambient light measurement from the ambient light sensor, obtain an input image to be displayed by the display, determine expected reflection data based on the ambient light measurement and display spectral reflectance data, determine color bleaching data based on the expected reflection data and a transformation of the input image, determine a color correction factor based on the color bleaching data and the transformation of the input image, apply the color correction factor to the transformation of the input image, and generate a compensated output image for display based on the transformation of the input image with the color correction factor applied.

In accordance with other aspects of the subject disclosure, a method for operating an electronic device having a display is provided, the method including obtaining an image to be displayed by the display, obtaining a measurement of ambient light in an environment around the electronic device, transforming the image to a perceptually uniform color space, determining a color correction for the image based on the measurement of the ambient light and the transformed image, and generating a compensated image based on the transformed image and the color correction.

In accordance with other aspects of the subject disclosure, a method for operating an electronic device having a display is provided, the method including obtaining an image to be displayed by the display, obtaining a measurement of ambient light in an environment around the electronic device, obtaining reflected light tristimulus values, determining a color correction for the image based on the reflected light tristimulus values and a color transformation of the image, and generating a compensated image based on the color transformation of the image and the color correction.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people.

For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device, comprising:

a display having an array of display pixels configured to emit colored display light;

an ambient light sensor; and processing circuitry configured to:

transform an image to be displayed with the display to a perceptually uniform color space;

obtain an ambient light measurement from the ambient light sensor;

determine expected reflection data based on the ambient light measurement;

determine color bleaching data based on the expected reflection data and the transformed image;

determine a color compensation factor based on the transformed image and the color bleaching data;

apply the color compensation factor to the transformed image;

perform an inverse transform of the transformed image with the color compensation factor applied to obtain a compensated image; and provide the compensated image to the display, for display by the array of display pixels.

2. The electronic device of claim 1, wherein the processing circuitry is further configured to determine a spectral power distribution of ambient light in an environment of the electronic device based on the ambient light measurement.

3. The electronic device of claim 2, wherein the processing circuitry is further configured to determine reflected light tristimulus values for a reflected portion of the ambient light based on the spectral power distribution, and based on display spectral reflectance data and color matching data stored in memory of the electronic device.

4. The electronic device of claim 3, wherein the processing circuitry is further configured to determine image tristimulus values for the image.

5. The electronic device of claim 4, wherein the processing circuitry is further configured to determine bleached image tristimulus values by combining the reflected light tristimulus values and the image tristimulus values.

6. The electronic device of claim 5, wherein the processing circuitry is further configured to transform the bleached image tristimulus values to bleached image perceptually uniform color space values.

7. The electronic device of claim 6, wherein the processing circuitry is further configured to:

transform the image to be displayed with the display to the perceptually uniform color space, at least in part by transforming the image tristimulus values to image perceptually uniform color space values; and determine the color compensation factor by combining the bleached image perceptually uniform color space values with the image perceptually uniform color space values.

8. The electronic device of claim 7, wherein the processing circuitry is further configured to:

determine a color compensation strength based on the ambient light measurement; and apply the color compensation strength to the transformed image with the color compensation factor applied, prior to performing the inverse transform.

9. The electronic device of claim 7, wherein the image perceptually uniform color space values comprise a brightness value, a redness-greenness value, and a yellowness-blueness value for the image, and wherein the color compensation factor comprises a first compensation factor for the redness-greenness value and a second compensation factor for the yellowness-blueness value.

10. An electronic device, comprising:

a display having an array of display pixels configured to emit colored display light;

an ambient light sensor; and processing circuitry configured to:

obtain an ambient light measurement from the ambient light sensor;

obtain an input image to be displayed by the display;

determine expected reflection data based on the ambient light measurement and display spectral reflectance data;

determine color bleaching data based on the expected reflection data and a transformation of the input image;

determine a color correction factor based on the color bleaching data and the transformation of the input image;

apply the color correction factor to the transformation of the input image; and generate a compensated output image for display based on the transformation of the input image with the color correction factor applied.

11. The electronic device of claim 10, wherein the display spectral reflectance data comprises a plurality of spectral reflectances of the display under a corresponding plurality of ambient light types.

12. The electronic device of claim 11, wherein the ambient light measurement comprises a brightness and a color of ambient light detected by the ambient light sensor.

13. The electronic device of claim 12, wherein the input image is a red-green-blue image, and wherein the processing circuitry is further configured to:

determine tristimulus values for the red-green-blue image;

determine image cone responses from the determined tristimulus values; and determine perceptually uniform color space values from the image cone responses to obtain the transformation of the input image.

14. The electronic device of claim 13, wherein the perceptually uniform color space values comprise a redness-greenness value and yellowness-blueness value for the input image.

15. The electronic device of claim 14, wherein the color correction factor comprises a first color correction factor for the redness-greenness value and a second color correction factor for the yellowness-blueness value.

16. A method for operating an electronic device having a display, the method comprising:

obtaining an image to be displayed by the display;

obtaining a measurement of ambient light in an environment around the electronic device;

transforming the image to a perceptually uniform color space;

determining expected reflection data based on the ambient light measurement;

determining color bleaching data based on the expected reflection data and the transformed image;

determining a color correction for the image based on the color bleaching data and the transformed image; and generating a compensated image based on the transformed image and the color correction.

17. The method of claim 16, further comprising obtaining tristimulus values for a reflected portion of the ambient light.

18. A method for operating an electronic device having a display, the method comprising:

obtaining an image to be displayed by the display;

obtaining a measurement of ambient light in an environment around the electronic device;

obtaining reflected light tristimulus values;

determining color bleaching data based on the reflected light tristimulus values and a color transformation of the image;

determining a color correction for the image based on the color bleaching data and the color transformation of the image; and generating a compensated image based on the color transformation of the image and the color correction.

19. The method of claim 18, wherein obtaining the reflected light tristimulus values comprises computing the reflected light tristimulus values directly from one or more channel readings of an ambient light sensor of the electronic device.

20. The method of claim 18, wherein obtaining the reflected light tristimulus values comprises determining a spectral power distribution of the ambient light based on the measurement of the ambient light.

21. The method of claim 20, wherein obtaining the reflected light tristimulus values further comprises integrating the spectral power distribution with a display spectral reflectance of the display and a color matching function.

* * * * *